US008839809B1

(12) United States Patent
Wang

(10) Patent No.: US 8,839,809 B1
(45) Date of Patent: Sep. 23, 2014

(54) ATTACHMENT FOR DIFFERENT AIR VALVES

(71) Applicant: Beto Engineering & Marketing Co., Ltd., Taichung (TW)

(72) Inventor: Lo Pin Wang, Taichung (TW)

(73) Assignee: Beto Engineering & Marketing Co., Ltd., Beitun Taichung (TW)

( * ) Notice: Subject to any disclaimer, the term of this patent is extended or adjusted under 35 U.S.C. 154(b) by 75 days.

(21) Appl. No.: 13/802,908

(22) Filed: Mar. 14, 2013

(51) Int. Cl.
*F16K 15/20* (2006.01)

(52) U.S. Cl.
CPC ..... *F16K 15/20* (2013.01)
USPC ..... 137/223; 137/231

(58) Field of Classification Search
USPC ..... 137/223, 231, 625.42; 152/415; 251/149.7
See application file for complete search history.

(56) References Cited

U.S. PATENT DOCUMENTS 5,638,865 A * 6/1997 Wu ..... 137/223
5,645,100 A 7/1997 Chuang et al.
5,666,990 A * 9/1997 Wu ..... 137/223
5,683,234 A 11/1997 Chuang et al.
5,921,269 A * 7/1999 Wu ..... 137/223
6,076,544 A * 6/2000 Pierce ..... 137/223
7,562,671 B2 * 7/2009 Wang ..... 137/231
7,866,335 B2 1/2011 Wang
8,156,955 B2 * 4/2012 Wang ..... 137/231
8,360,090 B2 * 1/2013 Wang ..... 137/223
8,402,987 B2 * 3/2013 Wang ..... 137/223
8,720,474 B2 * 5/2014 Wang ..... 137/231
8,720,475 B2 * 5/2014 Wu ..... 137/231

* cited by examiner

*Primary Examiner* — Craig Schneider
*Assistant Examiner* — Craig J Price
(74) *Attorney, Agent, or Firm* — Charles E. Baxley

(57) ABSTRACT

An air valve connecting device or attachment includes a housing having an inlet mouth, a sliding member slidably engaged in the housing and extendible out of the housing, the sliding member includes two pathways and two chambers communicating with each other, two gaskets are engaged into the chambers of the sliding member respectively for engaging with different inflation valves, and the outer peripheral walls for forming the chambers of the sliding member are compressible to engage with the gaskets and to grasp and retain the inflation valves and the gaskets in the chambers of the sliding member respectively when either of the outer peripheral walls is engaged into the housing.

7 Claims, 3 Drawing Sheets

ATTACHMENT FOR DIFFERENT AIR VALVES

BACKGROUND OF THE INVENTION

1. Field of the Invention

The present invention relates to an air valve connecting head or device or attachment, and more particularly to an air valve connecting device or attachment including an improved structure for connecting to different inflation valves and for preventing an air leaking from the inflation valves and the attachment.

2. Description of the Prior Art

Typical air valve connecting devices or attachments comprise one or more fitting ports or mouths formed or provided in a valve housing for receiving or engaging with inflation valves or nozzles and for selectively inflating various kinds of balls, inner tires of the bicycles or the motorcycles or the vehicles, or other inflatable articles.

For example, U.S. Pat. No. 5,683,234 to Chuang et al., and U.S. Pat. No. 5,645,100 to Chuang et al. disclose two of the typical hand operated, dual chambered, pneumatic pumps comprising a fitting member or attachment for selectively or alternatively engaging with different nozzles or tire valves, such as the U.S. type inflation valve or the French type inflation valve, or the like.

However, the typical air valve connecting heads or fittings comprise a structure that may occupy a great space or volume and that may not be easily operated or may not effectively grasp or hold the different inflation valves, and may have an air leaking problem occurring through either the inflation valve or the attachment.

U.S. Pat. No. 7,866,335 to Wang discloses another typical air valve connecting heads for the hand-held air pump and comprising a fitting device or attachment for selectively or alternatively engaging with different tire valves, such as the U.S. type inflation valve or the French type inflation valve, or the like.

However, the typical air valve connecting heads or attachments also comprise a structure that may not be easily operated or may not effectively grasp or hold the different inflation valves, and may have an air leaking problem occurring through either the inflation valve or the attachment.

The present invention has arisen to mitigate and/or obviate the afore-described disadvantages of the conventional air valve connecting devices or attachments.

SUMMARY OF THE INVENTION

The primary objective of the present invention is to provide an air valve connecting device or attachment including an improved structure for connecting to different inflation valves and for preventing air leaking from the inflation valves and the attachment.

In accordance with one aspect of the invention, there is provided an air valve connecting device comprising a housing including a compartment formed therein, and including an inlet mouth having an entrance for receiving pressurized air, a sliding member slidably received and engaged in the compartment of the housing and including a length greater than that of the housing for allowing an upper portion and a lower portion of the sliding member to be selectively extended out of the housing, the sliding member including a first pathway and a second pathway laterally formed in a middle portion of the sliding member and spaced from each other for selectively aligning with the entrance of the inlet mouth and for selectively receiving the pressurized air from the inlet mouth, the sliding member including a first chamber and a second chamber formed in the upper portion and the lower portion of the sliding member respectively and each formed and defined by an outer peripheral wall, the first and the second chambers of the sliding member being communicating with the first and the second pathways of the sliding member respectively for allowing the pressurized air to selectively flow from the first and the second pathways into the first and the second chambers of the sliding member respectively, and a first gasket and a second gasket engaged into the first and the second chambers of the sliding member respectively, the first and the second gaskets each including a bore formed therein for engaging with a first inflation valve and a second inflation valve respectively, and the outer peripheral walls of the sliding member being selectively compressed to engage with the first and the second gaskets in order to grasp and retain the first and the second inflation valves and the first and the second gaskets in the first and the second chambers of the sliding member respectively.

The sliding member includes a first opening formed therein and communicating between the first pathway and the first chamber of the sliding member, and a second opening formed therein and communicating between the second pathway and the second chamber of the sliding member.

The housing includes a first anchoring member and a second anchoring member provided in an upper portion and a lower portion of the housing respectively, and the sliding member includes a first retaining element and a second retaining element provided in the upper portion and the lower portion of the sliding member respectively for selectively engaging with the first and the second anchoring members of the housing respectively and for anchoring the sliding member to the housing at a first position and a second position respectively.

The sliding member includes two peripheral flanges extended radially and outwardly from the upper portion and the lower portion of the sliding member respectively for selectively engaging with the housing and for anchoring the sliding member to the housing.

The peripheral flanges of the sliding member are extended radially and inwardly from the upper portion and the lower portion of the sliding member respectively for selectively engaging with the first and the second gaskets and for solidly and stably retaining the first and the second gaskets in the first and the second chambers of the sliding member respectively.

The sliding member includes at least one slot formed in each of the outer peripheral walls for forming at least one spring blade in each of the outer peripheral walls and for increasing a resilience of the outer peripheral walls of the sliding member and for allowing the outer peripheral walls to be suitably compressed to engage with and to press the gaskets.

The sliding member includes an inclined outer peripheral surface formed and provided in each of the outer peripheral walls for allowing the outer peripheral walls to be compressed to move radially and inwardly to engage with and to press the first and the second gaskets onto the first and the second inflation valves respectively.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
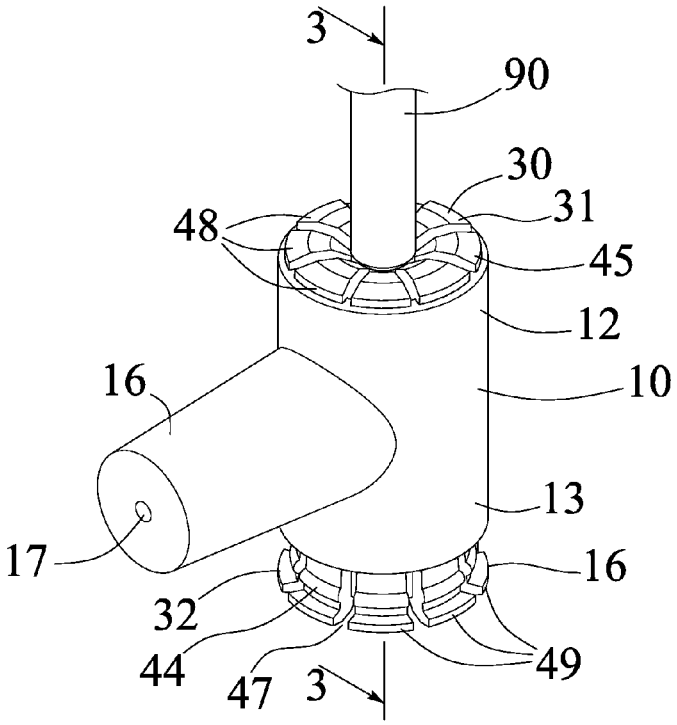
FIG. 1 is a partial perspective view of an air valve connecting device or attachment in accordance with the present invention.
Figure 2:
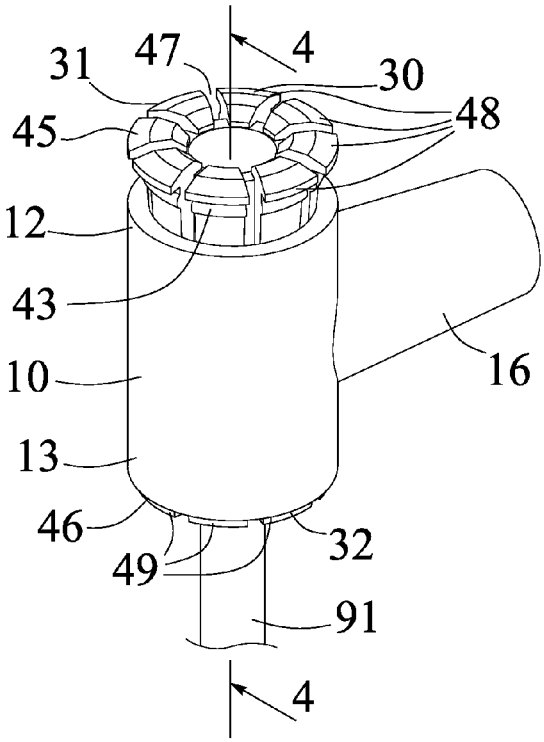
FIG. 2 is another partial perspective view similar to FIG. 1, illustrating the operation of the air valve connecting device or attachment.
Figure 3:
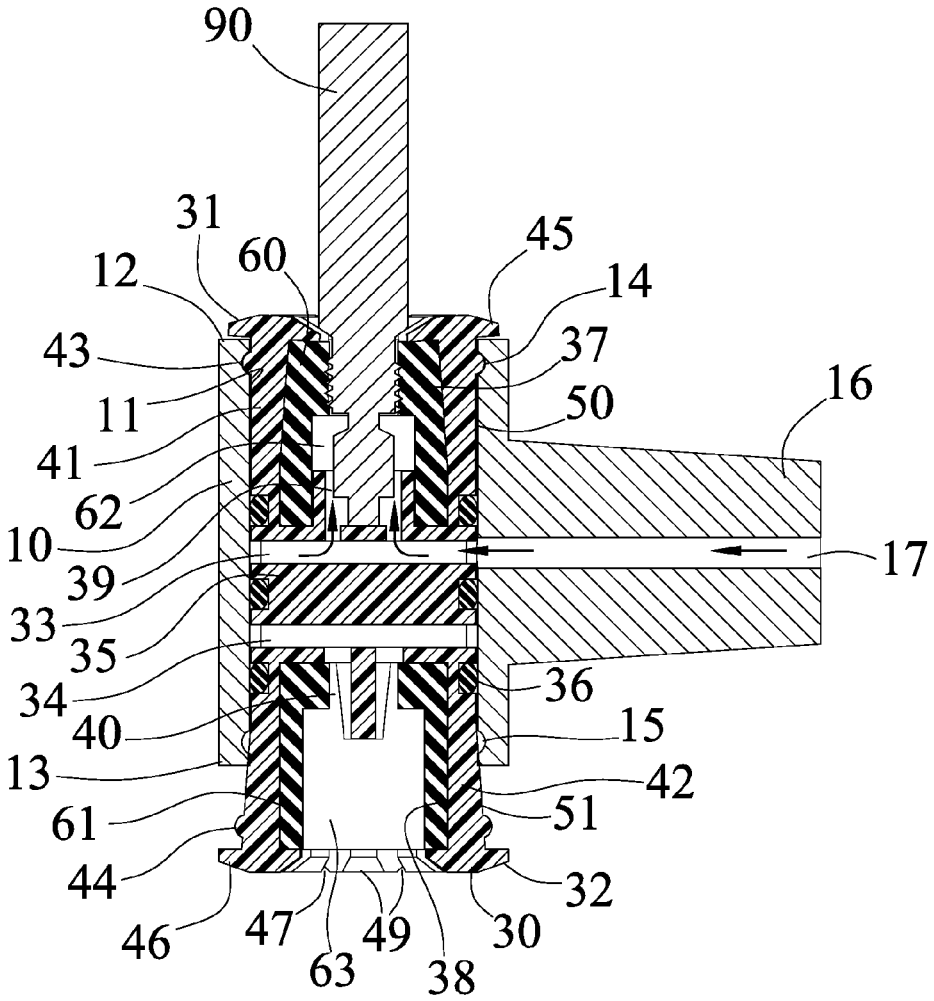
FIG. 3 is a cross sectional view of the air valve connecting device or attachment taken along lines 3-3 of FIG. 1.

Referring to the drawings, and initially to FIGS. 1-3, an air valve connecting device or attachment in accordance with the present invention comprises a head body or housing 10 including a compartment 11 formed therein and opened upwardly through an upper portion 12 of the housing 10 and also opened downwardly through a lower or bottom portion 13 of the housing 10 (FIGS. 3, 4), the housing 10 includes one or more (such as two) positioning or retaining or anchoring portions or devices or members 14, 15, such as inner peripheral depressions or recesses 14, 15 formed in the inner peripheral portion of the housing 10 and communicating with the compartment 11 of the housing 10, and disposed or located in the upper portion 12 and the lower or bottom portion 13 of the housing 10 respectively.

The housing 10 further includes a stud or extension or inlet mouth 16 extended laterally and outwardly therefrom for connecting or coupling to a pressurized air reservoir or hand-held air pump (not illustrated) or the like with such as hoses (not illustrated) for receiving the pressurized air from the air reservoir or hand-held air pump (not illustrated) or the like, and includes a lateral orifice or entrance 17 formed therein, such as formed in or through the inlet mouth 16 of the housing 10 and communicating with the compartment 11 of the housing 10 for and guiding the pressurized air to flow into the compartment 11 of the housing 10. The above-described structure or configuration for the connection mechanism or status between the inlet mouth 16 and the air reservoir or hand-held air pump (not illustrated) is typical and is not related to the present invention and will not be described in further details.

Figure 4:
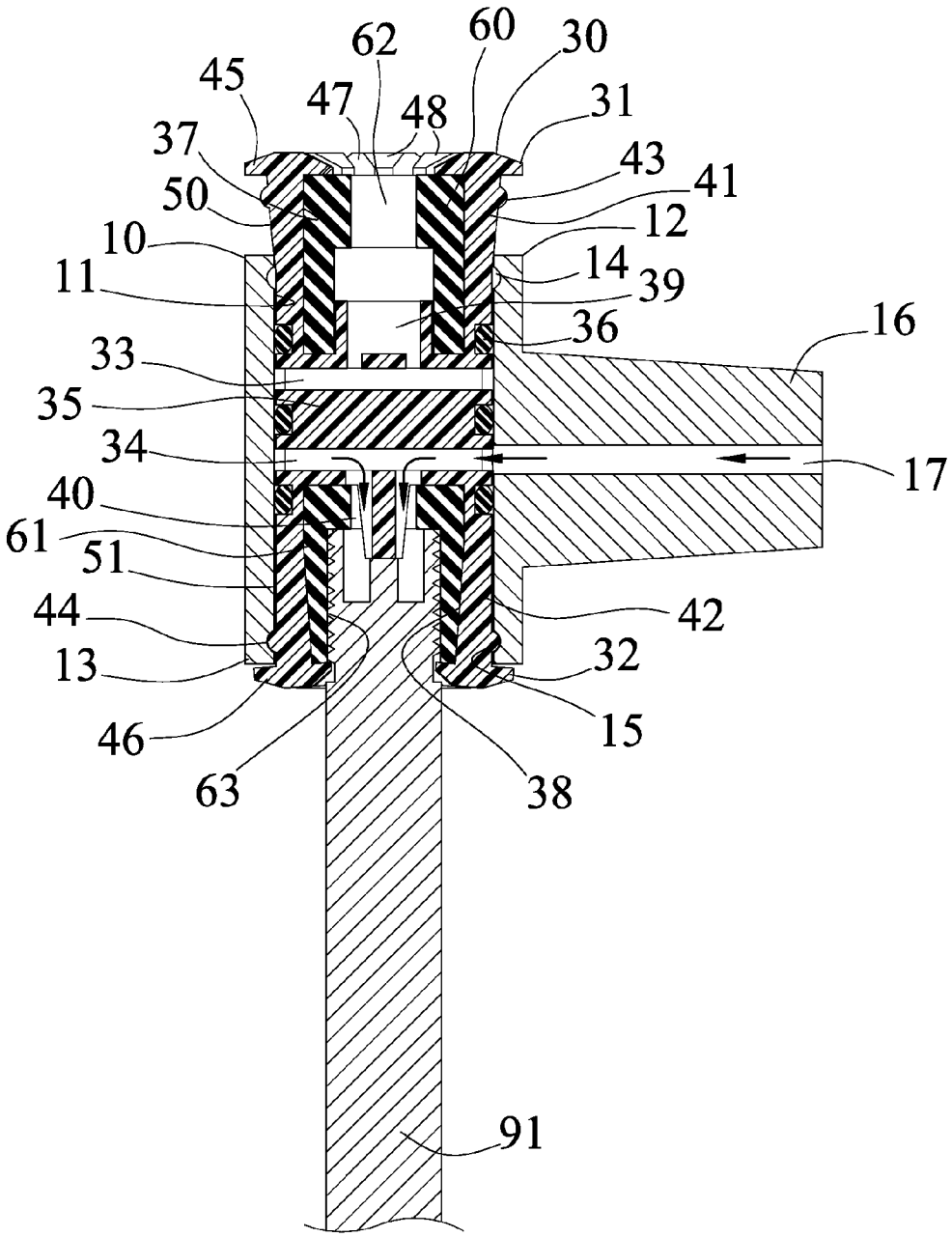
FIG. 4 is a cross sectional view of the air valve connecting device or attachment, illustrating the operation of the air valve connecting device or attachment.

The air valve connecting device or attachment further includes a valve piece or shank or sliding member 30 slidably or movably disposed or engaged into the compartment 11 of the housing 10, and the sliding member 30 includes a length greater than that of the housing 10 for allowing the upper portion 31 and/or the lower or bottom portion 32 of the sliding member 30 to be selectively extended out of the housing 10, and includes two passages or orifices or openings or conduits or pathways 33, 34 laterally formed in the middle or intermediate portion 35 of the sliding member 30 and disengaged or spaced or offset or separated from each other for selectively or changeably or alternatively aligning with or engaging with or communicating with the entrance 17 of the inlet mouth 16, best shown in FIGS. 3 and 4, and for selectively receiving the pressurized air from the air reservoir or hand-held air pump (not illustrated) or the like.

The air valve connecting device or attachment further includes two or more (such as three) sealing rings 36 attached or mounted or secured or engaged onto the sliding member 30, and contacted or engaged between the sliding member 30 and the housing 10 for selectively making a water or air tight seal between the sliding member 30 and the housing 10, for example, one of the sealing rings 36 is disposed or located between the pathways 33, 34 of the sliding member 30, and another sealing ring 36 is disposed or located above or higher than the upper or first pathway 33 of the sliding member 30, and a further sealing ring 36 is disposed or located below or lower than the lower or second pathway 34 of the sliding member 30 for preventing the pressurized air from leaking out through the adjacent or contact portion between the sliding member 30 and the housing 10.

The sliding member 30 includes two chambers 37, 38 formed therein, such as an upper or first chamber 37 and a lower or second chamber 38 formed in the upper portion 31 and the lower or bottom portion 32 of the sliding member 30 respectively and disengaged or spaced or offset or separated from the upper or first pathway 33 and the lower or second pathway 34 of the sliding member 30, and includes two mouths or openings 39, 40 formed therein, such as an upper or first opening 39 formed and disposed or located or communicating between the upper or first pathway 33 and the upper or first chamber 37, and a lower or second opening 40 formed and disposed or located or communicating between the lower or second pathway 34 and the lower or second chamber 38 for allowing the pressurized air to selectively flow from the pathways 33, 34 to the chambers 37, 38 of the sliding member 30 respectively.

The sliding member 30 includes two outer peripheral fences or walls 41, 42, such as an upper or first outer peripheral wall 41 and a lower or second outer peripheral wall 42 formed or provided therein for forming or defining the upper or first chamber 37 and the lower or second chamber 38 of the sliding member 30 respectively, and includes one or more (such as two) positioning or anchoring or retaining portions or devices or elements 43, 44, such as outer peripheral protrusions 43, 44 formed or provided on the outer peripheral portions of the outer peripheral walls 41, 42 respectively for selectively engaging with the anchoring members 14, 15 of the housing 10 respectively and for anchoring or securing or retaining or positioning the sliding member 30 to the housing 10 at selected or predetermined or different positions or locations.

For example, as shown in FIGS. 1 and 3, when the upper portion 31 of the sliding member 30 is depressed or forced to engage with or to engage into the compartment 11 and in the upper portion 12 of the housing 10, the upper or first pathway 33 of the sliding member 30 will be forced or moved to engage with or to be aligned with or communicating with the entrance 17 of the inlet mouth 16 or of the housing 10 for allowing the pressurized air to selectively flow into the upper or first chamber 37 of the sliding member 30, at this moment, the upper or first retaining element 43 will be engaged into or with the upper or first anchoring member 14 of the housing 10 for anchoring or securing or retaining or positioning the sliding member 30 to the housing 10 at the upper or first position where the upper or first pathway 33 of the sliding member 30 is aligned with or communicating with the entrance 17 of the inlet mouth 16 or of the housing 10.

On the contrary, as shown in FIGS. 2 and 4, when the lower or bottom portion 32 of the sliding member 30 is depressed or forced to engage with or to engage into the compartment 11 and in the lower or bottom portion 13 of the housing 10, the lower or second pathway 34 of the sliding member 30 will be forced or moved to engage with or to be aligned with or communicating with the entrance 17 of the inlet mouth 16 or of the housing 10 for allowing the pressurized air to selectively flow into the lower or second chamber 38 of the sliding member 30, at this moment, the lower or second retaining element 44 will be engaged into or with the lower or second anchoring member 15 of the housing 10 for anchoring or securing or retaining or positioning the sliding member 30 to the housing 10 at the lower or second position where the lower or second pathway 34 of the sliding member 30 is aligned with or communicating with the entrance 17 of the inlet mouth 16 or of the housing 10.

However, it is to be noted that the sliding member 30 may also be depressed or forced to engage with or into the compartment 11 of the housing 10 and anchored or retained or positioned in the upper or first position or in the lower or second position by or with a force fitted engagement, without the retaining elements 43, 44. The sliding member 30 further includes two peripheral flanges 45, 46 extended radially and outwardly from the upper portion 31 and the lower or bottom portion 32 of the sliding member 30 respectively for selectively engaging with the housing 10 and for further anchoring or securing or retaining or positioning the sliding member 30 to the housing 10 at the upper or first position or in the lower or second position, without the retaining elements 43, 44.

The sliding member 30 further includes two elastic grasping members or mouths or gaskets 60, 61 attached or mounted or secured or received or contained or engaged in the chambers 37, 38 of the sliding member 30 respectively, and the gaskets 60, 61 each include a bore 62, 63 formed therein and having a predetermined size or dimension or standard for receiving or engaging with different inflation valves 90, 91, such as the French type valve 90 (FIGS. 1 and 3) and the U.S. type valve 91 (FIGS. 2 and 4) or the like, and the gaskets 60, 61 are made of soft or elastic materials, such as rubber, plastic or other synthetic materials suitable or predetermined softness or resilience for being selectively depressed or compressed or squeezed or deformed to grip or grasp or hold or retain the inflation valves 90, 91 to the sliding member 30 respectively.

As shown in FIGS. 3 and 4, the peripheral flanges 45, 46 of the sliding member 30 may also be extended radially and inwardly from the upper portion 31 and the lower or bottom portion 32 of the sliding member 30 respectively for selectively engaging with the gaskets 60, 61 and for solidly and stably anchoring or securing or retaining or positioning or confining the gaskets 60, 61 in the chambers 37, 38 of the sliding member 30 respectively and for preventing the gaskets 60, 61 from being disengaged or separated from the sliding member 30. The sliding member 30 further includes one or more slits or slots 47 formed in each of the outer peripheral walls 41, 42 for forming or defining two or more elastic or resilient or spring blades 48, 49 in each of the outer peripheral walls 41, 42 and for increasing the resilience of the outer peripheral walls 41, 42 of the sliding member 30.

For example, as shown in FIGS. 1 and 3, when the French type valve 90 is engaged into the bore 62 of the gasket 60 and when the upper portion 31 of the sliding member 30 is depressed or forced to engage with or to engage into the compartment 11 and in the upper portion 12 of the housing 10, the spring blades 48 of the outer peripheral wall 41 of the sliding member 30 may be depressed or compressed or forced or squeezed to move radially and inwardly to engage with and to press the gasket 60 onto the inflation valve 90, and thus to solidly and stably anchor or retain or position or secure the French type valve 90 in the gasket 60 and in the upper or first chamber 37 of the sliding member 30, at this moment, the upper or first pathway 33 of the sliding member 30 is aligned with or communicating with the entrance 17 of the inlet mouth 16 or of the housing 10 for allowing the pressurized air to selectively flow from the pathway 33 of the sliding member 30 into the French type valve 90.

On the contrary, as shown in FIGS. 2 and 4, when the U.S. type valve 91 is engaged into the bore 63 of the other gasket 61 and when the lower or bottom portion 32 of the sliding member 30 is depressed or forced to engage with or to engage into the compartment 11 and in the lower or bottom portion 13 of the housing 10, the spring blades 49 of the outer peripheral wall 42 of the sliding member 30 may be depressed or compressed or forced or squeezed to move radially and inwardly to engage with and to press the gasket 61 onto the inflation valve 91, and thus to solidly and stably anchor or retain or position or secure the U.S. type valve 91 in the gasket 61 and in the lower or second chamber 38 of the sliding member 30, at this moment, the lower or second pathway 34 of the sliding member 30 is aligned with or communicating with the entrance 17 of the inlet mouth 16 or of the housing 10 for allowing the pressurized air to selectively flow from the pathway 34 of the sliding member 30 into the U.S. type valve 91.

It is preferable, but not necessary that the outer peripheral walls 41, 42 of the sliding member 30 each further include a tilted or inclined outer peripheral portion or surface 50, 51 formed or provided thereon for allowing the spring blades 48, 49 of the outer peripheral walls 41, 42 of the sliding member 30 to be depressed or compressed or forced or squeezed to move radially and inwardly to engage with and to press the gaskets 60, 61 onto the inflation valve 90, 91 respectively, and thus to solidly and stably anchor or retain or position or secure the different type valves 90, 91 in the gaskets 60, 61 and in the chambers 37, 38 of the sliding member 30 respectively. The air valve connecting device or attachment in accordance with the invention thus includes a simplified structure or configuration that may be made or manufactured with a greatly decreased or simplified manufacturing procedure and a greatly decreased manufacturing cost.

Accordingly, the air valve connecting device or attachment in accordance with the invention includes an improved structure for connecting to different inflation valves and for preventing an air leaking from the inflation valves and the attachment.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An air valve connecting device comprising:

a housing including a compartment formed therein, and including an inlet mouth having an entrance for receiving a pressurized air, a sliding member slidably received and engaged in said compartment of said housing and including a length greater than that of said housing for allowing an upper portion and a lower portion of said sliding member to be selectively extended out of said housing, said sliding member including a first pathway and a second pathway laterally formed in a middle portion of said sliding member and spaced from each other for selectively aligning with said entrance of said inlet mouth and for selectively receiving the pressurized air from said inlet mouth, said sliding member including a first chamber and a second chamber formed in said upper portion and said lower portion of said sliding member respectively and each formed and defined by an outer peripheral wall, said first and said second chambers of said sliding member being communicating with said first and said second pathways of said sliding member respectively for allowing the pressurized air to selectively flow from said first and said second pathways into said first and said second chambers of said sliding member respectively, and a first gasket and a second gasket engaged into said first and said second chambers of said sliding member respectively, said first and said second gaskets each including a bore formed therein for engaging with a first inflation valve and a second inflation valve respectively, and said outer peripheral walls of said sliding member being selectively compressed to engage with said first and said second gaskets in order to grasp and retain said first and said second inflation valves and said first and said second gaskets in said first and said second chambers of said sliding member respectively.

2. The air valve connecting device as claimed in claim 1, wherein said sliding member includes a first opening formed therein and communicating between said first pathway and said first chamber of said sliding member, and a second opening formed therein and communicating between said second pathway and said second chamber of said sliding member.

3. The air valve connecting device as claimed in claim 1, wherein said housing includes a first anchoring member and a second anchoring member provided in an upper portion and a lower portion of said housing respectively, and said sliding member includes a first retaining element and a second retaining element provided in said upper portion and said lower portion of said sliding member respectively for selectively engaging with said first and said second anchoring members of said housing respectively and for anchoring said sliding member to said housing at a first position and a second position respectively.

4. The air valve connecting device as claimed in claim 1, wherein said sliding member includes two peripheral flanges extended radially and outwardly from said upper portion and said lower portion of said sliding member respectively for selectively engaging with said housing and for anchoring said sliding member to said housing.

5. The air valve connecting device as claimed in claim 4, wherein said peripheral flanges of said sliding member are extended radially and inwardly from said upper portion and said lower portion of said sliding member respectively for selectively engaging with said first and said second gaskets and for solidly and stably retaining said first and said second gaskets in said first and said second chambers of said sliding member respectively.

6. The air valve connecting device as claimed in claim 1, wherein said sliding member includes at least one slot formed in each of said outer peripheral walls for forming at least one spring blade in each of said outer peripheral walls and for increasing a resilience of said outer peripheral walls of said sliding member.

7. The air valve connecting device as claimed in claim 1, wherein said sliding member includes an inclined outer peripheral surface formed and provided in each of said outer peripheral walls for allowing said outer peripheral walls to be compressed to move radially and inwardly to engage with and to press said first and said second gaskets onto said first and said second inflation valves respectively.

* * * * *